US005603233A

United States Patent [19]

Erickson et al.

[11] Patent Number: 5,603,233

[45] Date of Patent: Feb. 18, 1997

[54] APPARATUS FOR MONITORING AND CONTROLLING THE OPERATION OF A MACHINE FOR WASHING ARTICLES

[75] Inventors: Timothy K. Erickson, Lena; Gary R. O'Brien, Freeport; Ian F. Reeve, Rockford, all of Ill.

[73] Assignee: Honeywell Inc., Minneapolis, Minn.

[21] Appl. No.: 501,354

[22] Filed: Jul. 12, 1995

[51] Int. Cl.[6] ..... D06F 33/02

[52] U.S. Cl. ..... 68/12.02

[58] Field of Search ..... 68/12.02; 134/57 D

[56] References Cited

U.S. PATENT DOCUMENTS 4,257,708 3/1981 Fukuda ..... 356/435
5,172,572 12/1992 Ono ..... 68/12.02
5,241,845 9/1993 Ishibashi et al. ..... 68/12.02
5,291,626 3/1994 Molnar et al. ..... 8/158

FOREIGN PATENT DOCUMENTS 2485576 12/1981 France .

*Primary Examiner*—Philip R. Coe
*Attorney, Agent, or Firm*—William D. Lanyi

[57] ABSTRACT

A machine for washing articles is provided with a wash process sensor that is capable of measuring a plurality of physical parameters that relate to the progress of a washing procedure. The wash process sensor also monitors the changes in the measured parameters and calculates a value that represents the degree of cleanliness or dirtiness of the articles being washed. In one embodiment, the wash process sensor also directly controls a plurality of devices, such as motors, heaters, dispensers and valves, to directly control the washing process.

20 Claims, 14 Drawing Sheets

(PRIOR-ART)

CYCLE START ROUTINE

APPARATUS FOR MONITORING AND CONTROLLING THE OPERATION OF A MACHINE FOR WASHING ARTICLES

BACKGROUND OF THE INVENTION

1. Field of the Invention:

The present invention generally relates to a device that can monitor a plurality of parameters and control a plurality of devices relating to the washing of articles and, more particularly, to a monitoring and control apparatus that incorporates a wash process sensor that comprises a microcontroller which is capable of performing measuring, monitoring, calculating and controlling the process of washing articles.

2. Description of the Prior Art:

Many different machines for washing articles are known to those skilled in the art. In addition, numerous dishwashers and clothes washing machines are known which measure parameters relating to the washing process and provide information which is helpful in determining the degree of cleanliness or dirtiness of the articles being washed. One commonly measured parameter relates to the turbidity of the water used in the washing process. By monitoring the degree of turbidity of the wash solution, the satisfactory progression of the process can be determined.

U.S. Pat. No. 5,172,572, which issued to Ono on Dec. 22, 1992, discloses an automatic washing apparatus for washing dirty items in a tank to which washing liquid is supplied. The apparatus is described as comprising a light emitting element for emitting light to the washing liquid which is past through the washing tank. A first light receiving element is provided for receiving a light beam that travels through the washing liquid along the optical axes of the light emitting element. A second light receiving element for receiving scattered light that travels through the washing liquid in directions deviated from the optical axis of the light emitting element is also provided. The washing conditions are controlled in accordance with the quantity of light received by the first light receiving element and the quantity of light received by the second light receiving element.

U.S. Pat. No. 5,291,626, which issued to Molnar et al on Mar. 8, 1994, describes a machine for cleansing articles. The machine can be a dishwasher. It incorporates a device for measuring the turbidity of at least partially transparent liquid. The device includes a sensor for detecting scattered electromagnetic radiation, regardless of polarization, and a sensor for detecting transmitted electromagnetic radiation regardless of polarization.

U.S. patent application Ser. No. 08/246,902, which was filed on May 20, 1994 by Boyer et al and assigned to the Assignee of the present application, discloses a sensor platform for use in machines for washing articles. A plurality of fluid condition sensors are combined together to provide a sensor cluster that senses turbidity, temperature, conductivity and the movement of the ferromagnetic object. The plurality of sensors are attached to a substrate and encapsulated, by an overmolding process, with a light transmissive and fluid impermeable material. The sensor cluster can be disposed at various different locations within a body of fluid and does not require a conduit to direct the fluid to a particular location proximate the sensor. In a preferred embodiment of the present invention, a circuit is provided which monitors the signal strength of first and second light sensitive components to determine turbidity and, in addition, those signal strengths are also used to advantageously determine the most efficient magnitude of current necessary to drive a light source, such as the light emitting diode. By controlling the current to a light emitting diode as a function of the strength of light signal received by first and second light sensitive components, the turbidity sensor can be operated at a more efficient and effective level.

French patent 2,485,576, which was made public on Dec. 31, 1981, discloses a procedure for the adaptation of washing time and of the quantity of rinsing water for a load of laundry in a washing machine. This French patent, which was filed by Hazan et al on Jun. 24, 1980, describes a laundry machine in which electrical signals coming from photodetectors are monitored by a microprocessor with a read-only memory, a random-access memory and a comparative element. A program is stored in the read-only memory of the microprocessor and is used during continuous washing and rinsing or in cycles used by the machine. During the washing or rinsing procedures the active memory stores the value of the signal coming from the photodetectors for a series of instance in time. If the signals exhibit very slight change, the microprocessor interprets this situation as corresponding to the reaching of a limit for the opacity of the washing water or for the degree of purity of the rinsing water. In that case, the comparator sends a signal to stop the washing or rinsing cycle. On the other hand, the washing or rinsing cycles can continue until a limit which is either opacity or the degree of purity of the water is detected.

U.S. Pat. No. 4,257,708, which issued to Fukuda on Mar. 24, 1981, describes an apparatus for measuring the degree of rinsing in an apparatus for washing articles. The apparatus for measuring the degree of rinsing is provided with a source of light, a first phototransistor disposed to receive light emitted by the light source for producing a reference signal, a second phototransistor disposed to receive the light from the light source for producing a measuring signal corresponding to the amount of light received an a calculating circuit for arithmetically operating the reference signal and the measuring signal for producing an output signal corresponding to the relative values of the reference signal and the measuring signal. A first optical path between the light source and the first phototransistor and a second optical path between the light source and the second phototransistor are both disposed in rinsing water and the length of the first optical path is set to be longer than the length of the second optical path.

As will be described in greater detail below, the use of a smart sensor in a machine for washing articles has been found to provide a significant benefit to the washing of articles. In particular, a turbidity sensor can be advantageously used to reduce the quantity of water used in the procedure of washing dishes. By monitoring the degree of turbidity and the rate of change of turbidity of the washing liquid, the timing of the washing and rinsing cycles can be advantageously controlled to reduce both the use of water and, in addition, the use of electricity. Therefore, smart sensors can improve both the efficiency and the effectiveness of the process of washing articles.

In typical applications known to those skilled in the art, sensors are used to measure various parameters relating to the washing of articles by an appliance. The measured parameters are then communicated to a controller which changes the rinsing and washing cycles in conformance with preselected algorithms. Certain disadvantages have been experienced in apparatus of this type. In applications where smart sensors are used to measure the parameters, a microprocessor or microcontroller is typically used as part of the sensor or sensors. However, since the controller typically uses a microcontroller also, the cost of the machine for washing articles is increased as a result of this redundancy in component usage. The cost of the machine is increased in several ways by a system that requires this number of components. Original manufacturing costs are naturally larger. In addition, wiring harnesses are required. Because of the larger number of devices, overall reliability of the total system is reduced. Assembly costs are increased because of the required interconnections. Since the various intelligent components must be able to communicate with each other, some type of communications protocol must also be included as part of the total system. It would therefore be significantly advantageous if a wash process sensor could be provided with the capability of measuring a plurality of parameters and is also the controlling the wash process.

SUMMARY OF THE INVENTION

The present invention provides an apparatus for monitoring and controlling the operation of a machine for washing articles which comprises a means for measuring a plurality of physical parameters that relate to the progress of washing the articles. Although many different parameters can be measured within the scope of the present invention, a preferred embodiment measures turbidity, conductivity, temperature and the movement of certain components of the machine. In addition, the present invention comprises a means for monitoring changes in the magnitude of the plurality of physical parameters over time to determine the progress of the washing process.

A particularly preferred embodiment of the present invention further comprises a means for calculating a numeric value as a function of the rates of change of the parameters and of the actual magnitudes of the physical parameters themselves which is representative of the cleanliness of the articles. In addition, a housing structure is provided in which the measuring, monitoring and calculating means are contained. A means is also provided for controlling the operation of a plurality of devices that affect the operation of the machine for washing articles. The controlling means can be contained in a common housing with the measuring, monitoring and calculating means, but this combination with a common housing is not a requirement in all embodiments of the present invention. The plurality of physical parameters described above can comprise the rotational speed of a wash arm when the machine for washing articles is a dishwasher. The monitoring means can comprise a microcontroller. In addition, the calculating means can comprise a microcontroller. The plurality of devices controlled by the present invention can comprise a motor, a dispenser and a valve. In certain applications of the present invention, the plurality of devices can comprise a blower motor, a detergent dispenser, a pump motor, a rinse aid dispenser and a heating coil. As will be understood from a reading of the Description of the Preferred Embodiment, the machine for washing articles can be either a dishwasher or a clothes washer. The particular type of machine for washing articles in which the present invention is applied is not limiting to its scope.

In one particularly preferred embodiment of the present invention, the housing in which the measuring, monitoring, calculating and controlling means are contained is disposed within a pump housing of the machine for washing articles. In certain applications of the present invention, fuzzy logic can be employed to execute certain calculations, but fuzzy logic is not required in all embodiments of the present invention.

BRIEF DESCRIPTION OF THE DRAWINGS

The present invention will be more fully and completely understood from a reading of the Description of the Preferred Embodiment in conjunction with the drawings, in which.

DESCRIPTION OF THE PREFERRED EMBODIMENT

Figure 1:
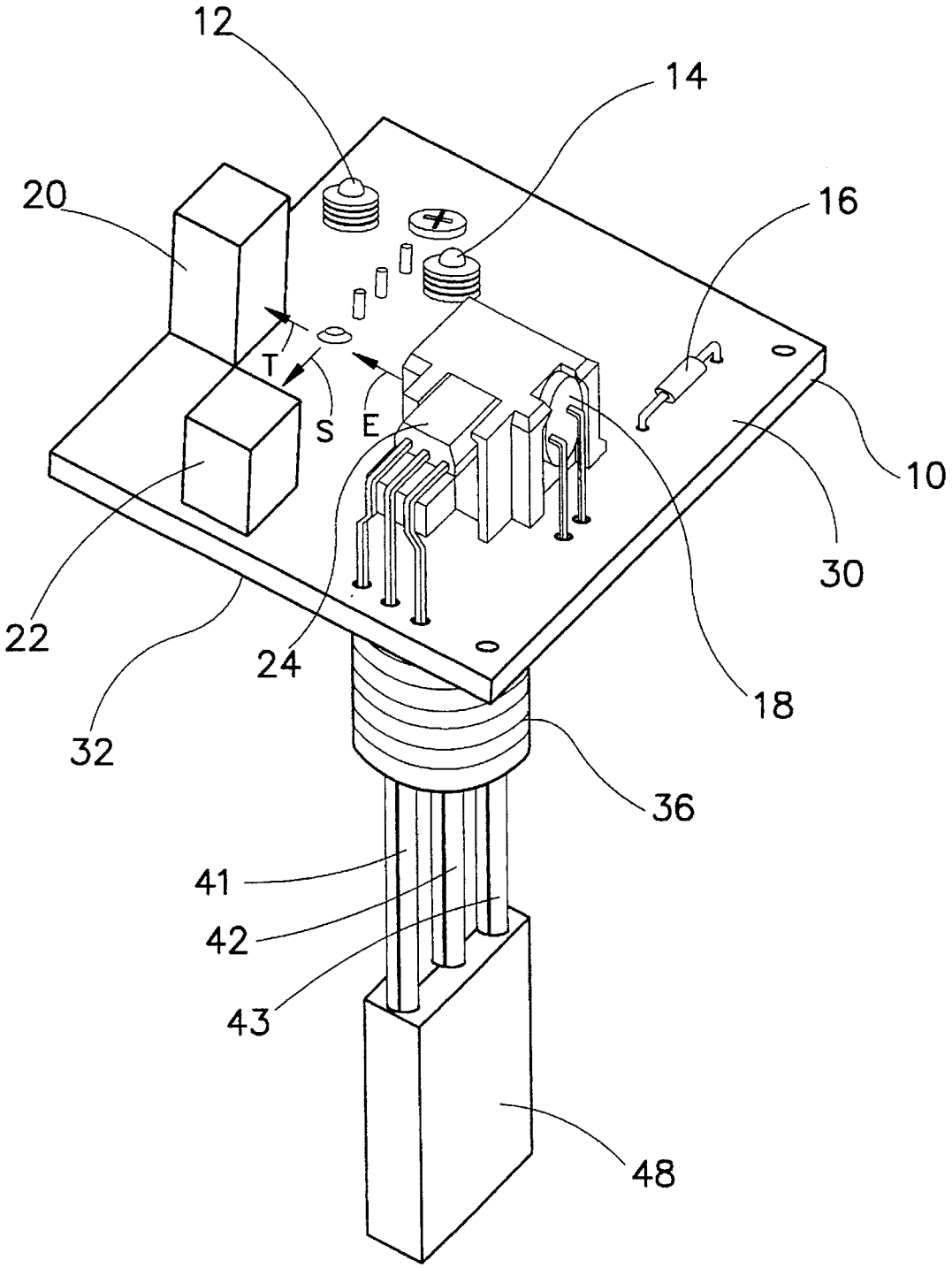
Fig. 1 (PRIOR ART)
FIG. 1 shows a wash process sensor known to those skilled in the art.

Throughout the Description of the Preferred Embodiment, like reference numerals will be used to identify like components.

FIG. 1 illustrates a known structure that is used as a wash process sensor. A platform 10 is provided on which a plurality of components are attached. Two electrical conductors, 12 and 14, are used as a conductivity sensor. A temperature sensitive component 16, such as a thermistor, is used to measure the temperature of the washing liquid. A light source 18, such as a light emitting diode, is used to provide a beam of emitted light E that is transmitted into a space above the platform 10. A first light sensitive component 20 receives transmitted light T and a second light sensitive component 22 receives scattered light S. A magnetically sensitive component 24 is disposed at a location proximate the path of a ferromagnetic object, such as the wash arm of a dishwasher. The platform 10 has an upper surface 30 and a lower surface 32. From the lower surface 32, a threaded portion 36 extends downward and permits the sensor platform to be rigidly attached to a portion of the machine for washing articles, such as the bottom wall of a pump housing. Three conductors, 41, 42 and 43, extend downward from the threaded portion 36 and provide electrical communication between a plug 48 and the electrical components mounted to the top surface 30 of the platform 10. FIG. 1 shows a structure that is described in explicit detail in patent application Ser. No. 08/246,902 which was filed on May 20, 1994 and assigned to the Assignee of the present application.

Figure 2:
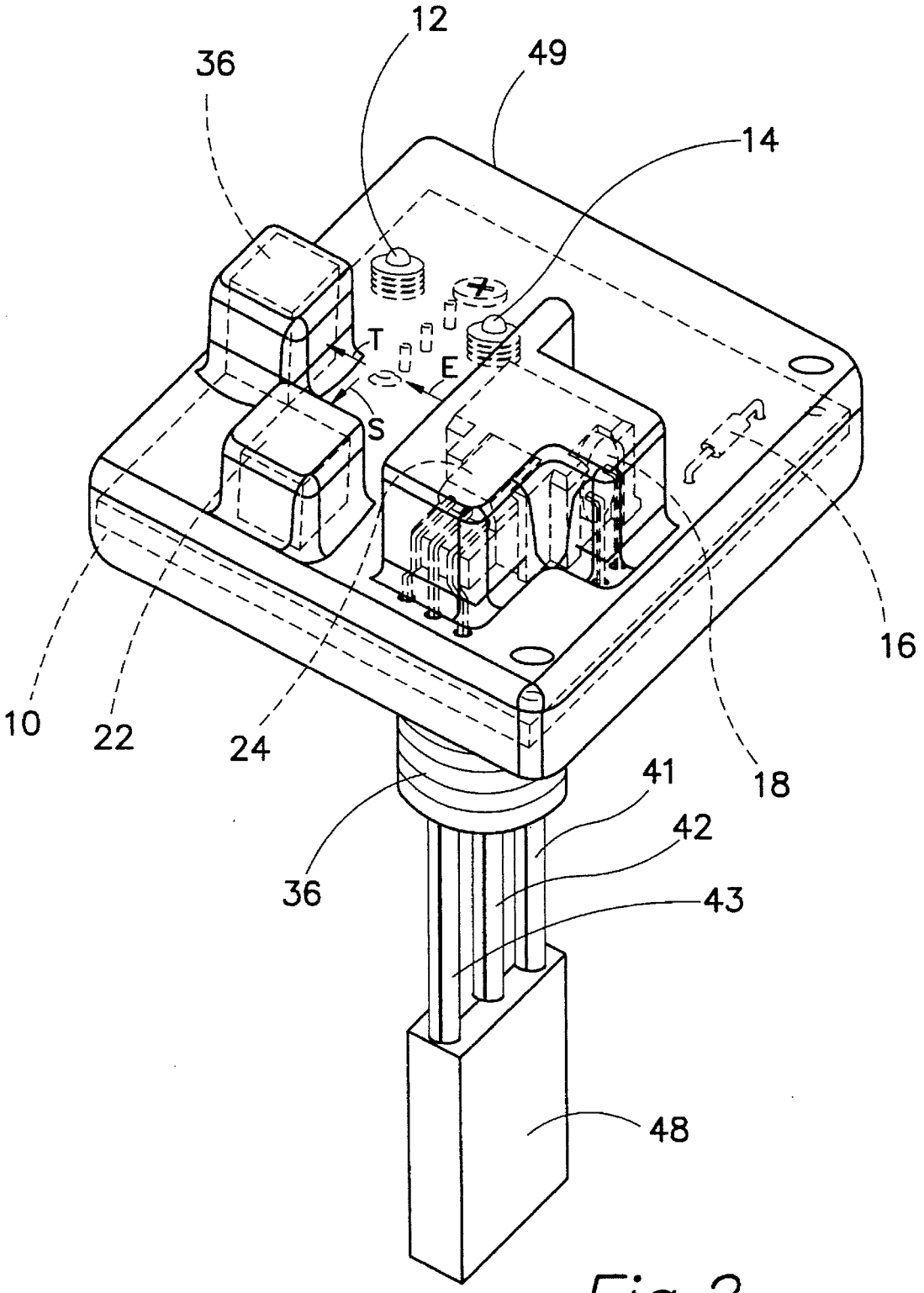
Fig. 2 (PRIOR ART)
FIG. 2 shows the wash process sensor of FIG. 1 encapsulated in a protective housing.

FIG. 2 shows the device of FIG. 1 after it is encapsulated within a plastic housing 49. The plastic housing provides protection for the electronic components an also provides transparent surfaces through which the emitted light E, the transmitted light T and the scattered light S can pass. The particular operation of the components shown in FIGS. 1 an 2 will not be described in detail because they are generally known to those skilled in the art and are described in the patent application discussed immediately above.

Figure 3:
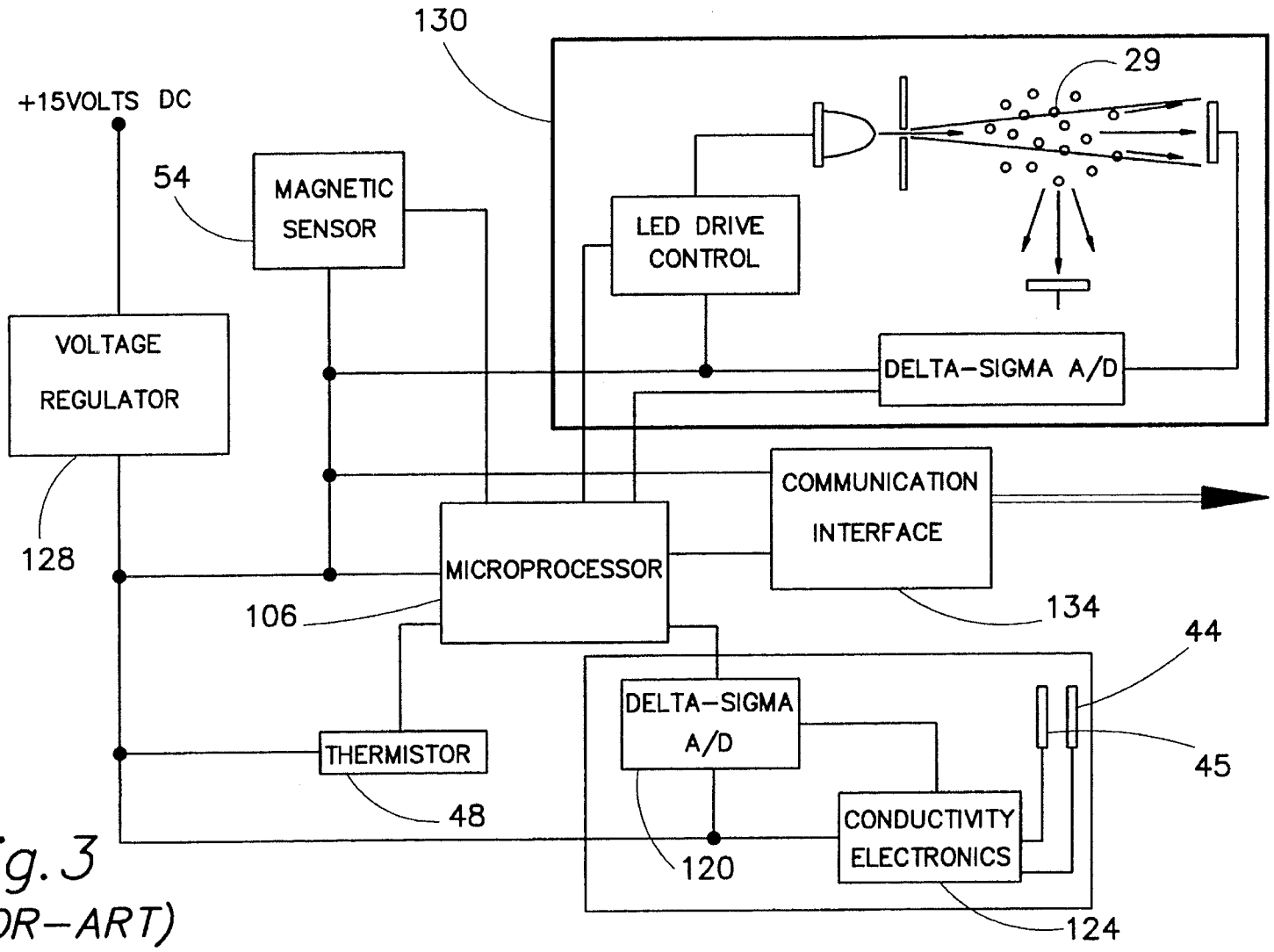
FIG. 3 is a schematic diagram showing the interconnections among the components of the wash process sensor shown in FIG. 2.

FIG. 3 shows an exemplary schematic diagram of a control circuit that can be used in conjunction with the device illustrated in FIGS. 1 and 2. In FIG. 3, the turbidity sensor 52 comprises a light emitting diode drive control circuit 54 and a Delta-Sigma analog-to-digital converter 56. The components identified as the turbidity sensor 52 are intended to provide information relating to the particulates 50 that pass through the region between the light emitting diode and the two photosensitive devices. Although not explicitly shown in FIGS. 1 and 2, the wash process sensor comprises a voltage regulator 60, Delta-Sigma analog-to-digital converter 66, conductivity electronics 68 an a microprocessor 70. The microprocessor 70 is used to control the operation of the components shown in FIG. 3 and to use the raw data provided by those sensors to calculate the magnitude of certain variables that are used to determine the turbidity, the conductivity and the temperature of the washing solution. In addition, the magnetic sensor 24 is used to determine certain information with regard to a movable component of the machine for washing articles, such as a wash arm of a dishwasher. In order to communicate the information determined by the microprocessor 70, a communication interface 80 is provided so that the calculated information can be transmitted to a controller of the machine for washing articles. That controller, in machines known to those skilled in the art, is used to control the operation of certain devices such as pumps, motors, valves, heaters and dispensers related to the machine for washing articles.

FIGS. 1, 2 and 3 illustrate a certain wash process sensor that is used in conjunction with a dishwasher. The operation and structure of the wash process sensor shown in FIGS. 1, 2 and 3 is described in detail in patent application Ser. No. 08/246,902 which is described above.

Figure 4:
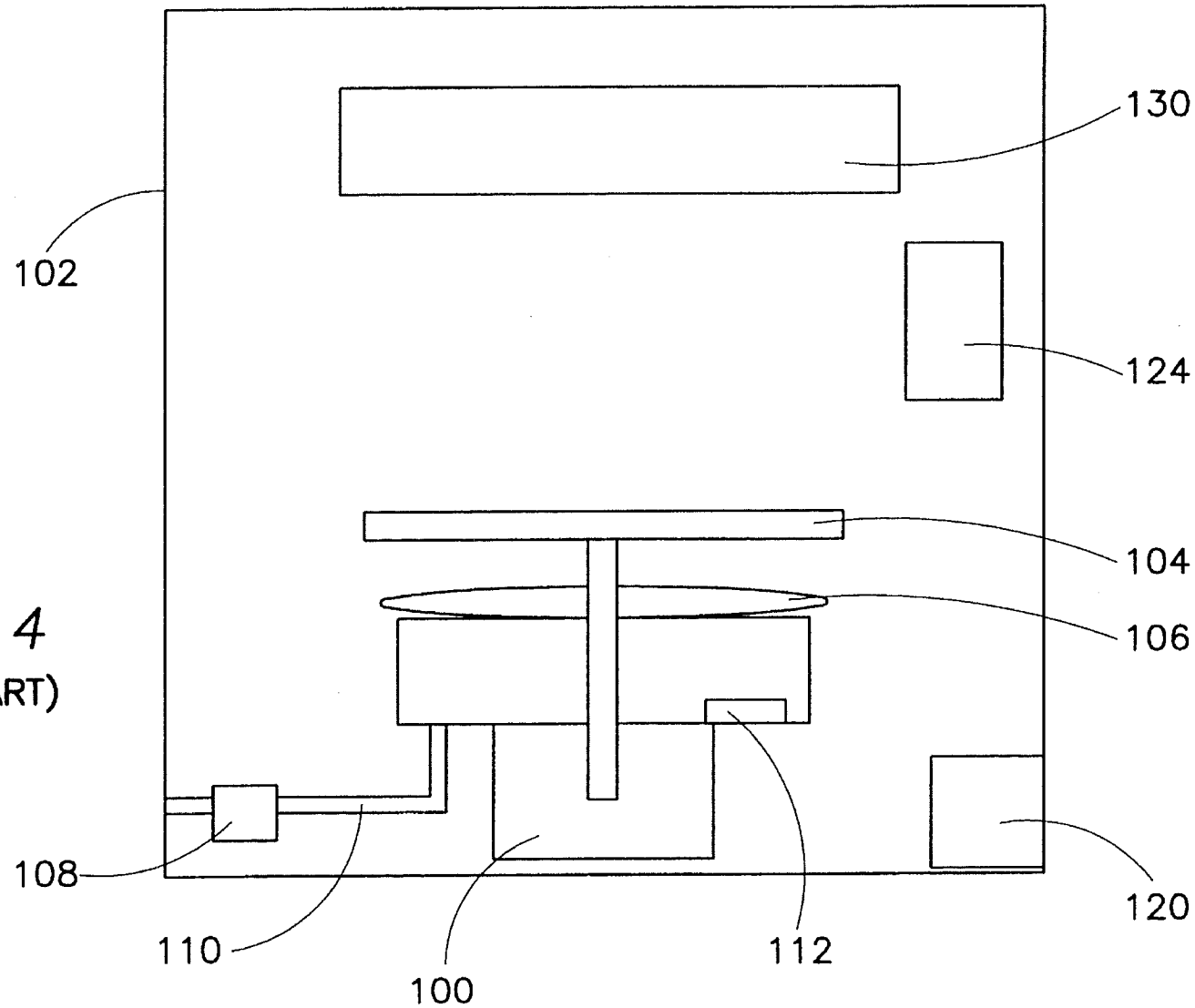
Fig. 4 (PRIOR ART)
FIG. 4 is a highly schematic representation of a machine for washing articles.

FIG. 4 is a highly simplified exemplary illustration of a machine for washing articles. It comprises a pump motor 100 that is used to pump water throughout the internal structure of the machine. In the illustration of FIG. 4, the machine for washing articles is a dishwasher 102. It has a rotating wash arm 104 that is typically driven by water pressure. In addition, it has a heating coil 106 and a valve 108 that is used to control the flow of water through a conduit 110. A wash process sensor 112, such as that described above in conjunction with FIGS. 1, 2 and 3, is disposed within a pump housing 114. In addition, a blower motor 120 is used to circulate air throughout the internal structure of the dishwasher 102. A dispenser 124 can also be provided to dispense either detergent or rinse aid material. A main controller which is identified by reference numeral 130, is used to control the operation of the valves, dispensers, motors and heaters in machines for washing articles. Depending on the level of sophistication of the machine, the controller 130 can comprise the ability to perform fuzzy logic and is used to control the wash routine as a function of information provided to it by sensors placed throughout the apparatus. Also depending on the sophistication of the machine, a plurality of individual sensors can be disposed at various locations within the structure of the machine for washing articles or, alternatively, a plurality of sensors can be contained within a common housing such as the wash process sensor 112. The particular algorithms used by the controller 120 can vary significantly.

Figure 5:
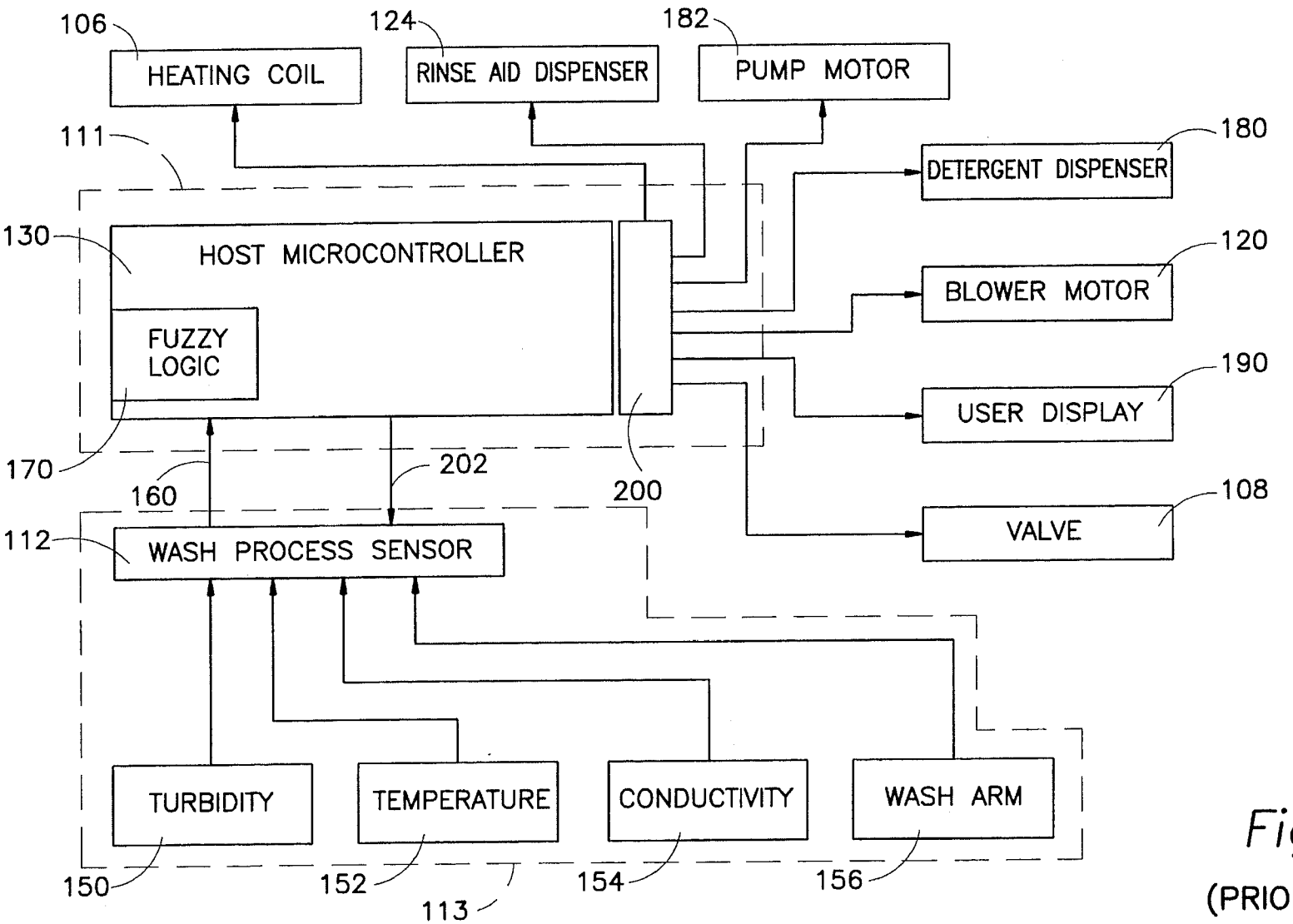
Fig 5 (PRIOR ART)
FIG. 5 shows a known arrangement of sensors, controllers and devices of a machine for washing articles.
Figure 6:
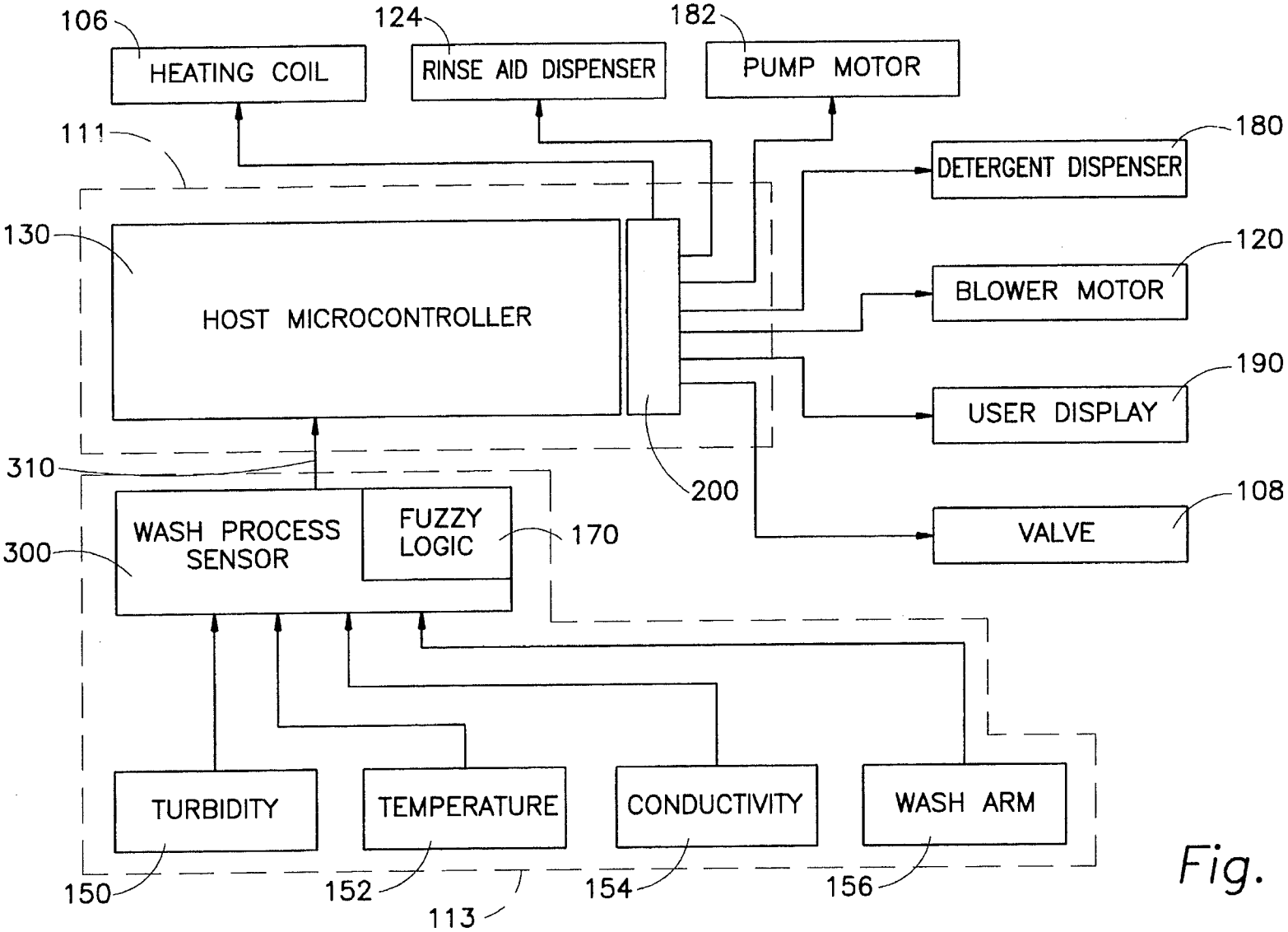
FIG. 6 shows one embodiment of the present invention.
Figure 7:
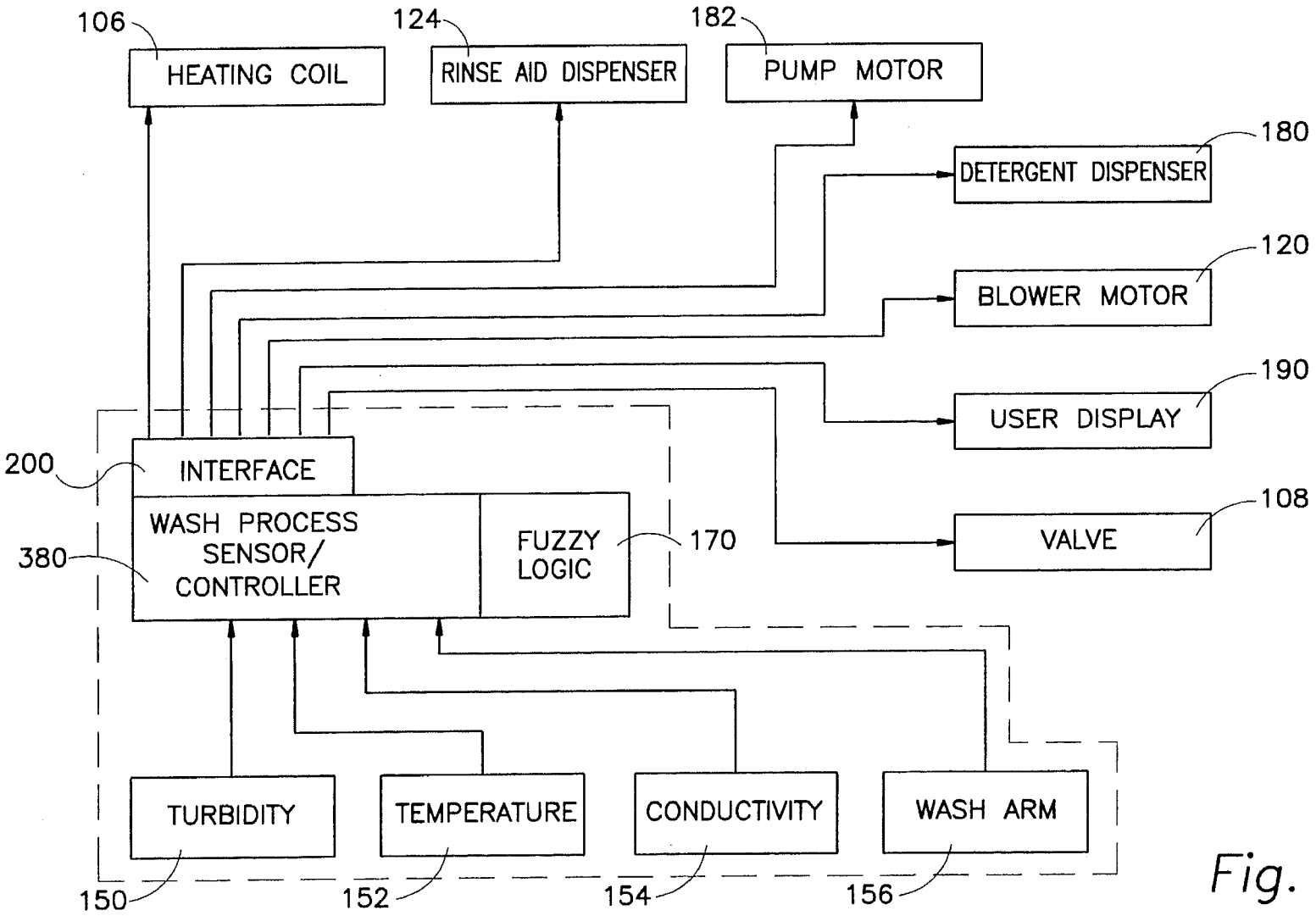
FIG. 7 shows another embodiment of the present invention.

In FIGS. 5, 6 and 7, reference numeral 111 is used to identify the main control portion of the machine for washing articles and reference numeral 113 is used to identify the wash process sensor portion of the machine for washing articles. FIG. 5 is a schematic diagram showing the transfer of information and control between the various components of machines for washing articles that are known to those skilled in the art. In FIG. 5, it is assumed that a wash process sensor is contained in a single unit 113 and is used to measure the plurality of physical parameters that are identified as turbidity 150, temperature 152, conductivity 154 and wash arm rotation 156. Information relating to these physical parameters is obtained by the wash process sensor 112 and, through the use of software contained in a microprocessor, the information is converted to a useable format and transmitted, on line 160, to a host microcontroller 130. The host microcontroller 130 is typically contained in a main control portion 111 of the machine for washing articles. The microcontroller receives the information on line 160 from the wash process sensor 112 and uses the information to determine the appropriate actions to be taken to efficiently control the washing process. The type of information passed by the wash process sensor 112 to the host microcontroller 130 would typically comprise two values of transmitted and scattered light, a temperature value, a conductivity value and a number representing the RPM of the wash arm. In this example, five numeric values are transmitted on line 160 by the wash process sensor 112 to the host microcontroller 130. In the embodiment shown in FIG. 5, the host microcontroller comprises a fuzzy logic kernel 170. However, the host microcontroller is not always equipped with fuzzy logic capability. After the raw information on line 160 is processed by the host microcontroller 130, certain decisions are made with regard to the physical devices that can affect the washing and rinsing cycles of the machine for washing articles. For example, the heating coil 106 can be turned on or turned off, the valve 108 can be opened or closed, the rinse aid dispenser 124 or the detergent dispenser 180 can be activated, the pump motor 182 or the blower motor 120 can be turned on or off and the user display 190 can be activated to inform the user of the machine for washing articles about the status of the washing process. Some type of interface module 200 is necessary to convert logic level voltage signals from the host microcontroller to output signals that are capable of controlling the physical devices shown in FIG. 5.

With continued reference to FIG. 5, the host microcontroller 130 determines when new information is required from the wash process sensor 112. At those times, the host microcontroller 130 provides a signal on line 202 to the wash processor 112 and requests updated information with regard to the measured physical parameters. Several problems exist with the arrangement shown in FIG. 5. First, the wash process sensor 112 can be disposed within a pump housing near the bottom of the machine for washing articles, and the host microcontroller 130 is typically located within a control panel at the upper portion of the machine for washing articles. This requires a set of wires to connect the host microcontroller 130 to the wash process sensor 112. Another disadvantage of the arrangement shown in FIG. 5 is that the wash process sensor 112 typically has updated information available to it regarding the measured physical parameters which are not known to the host microcontroller 130. That information is not transferred on line 160 until a request for information is received by the wash process sensor 112 on line 202. This means that the microcontroller can be operating with limited information. Valuable time might be required for the microcontroller to send a signal on line 202 to the wash process sensor 112 and, subsequently, for the wash process sensor to transmit the measured variables pertaining to the physical parameters. Since the physical parameters are continually changing during the washing process, the microcontroller must control the physical devices based on information that is not current. In addition to the disadvantages described above with regard to the necessary wiring, additional components, reduced reliability, increased assembly costs and the effect on the timing of the data transfer process, another disadvantage of the arrangement shown in FIG. 5 relates to the probable requirement of two microprocessors. The host microcontroller 130 is provided with microprocessing capability and possibly with a fuzzy logic kernel 170. If the wash process sensor 112 is a smart sensor, as is most probable, it also requires a microprocessor. Therefore, two microprocessors are used in the arrangement illustrate in FIG. 5.

FIG. 6 shows one embodiment of the present invention. The physical parameters being measured are the same as in the example describe above in conjunction with FIG. 5. In addition, for purposes of this discussion, the physical devices controlled during the washing process are the same. The primary difference between the embodiment of the present invention shown in FIG. 6 and the arrangement described above in conjunction with FIG. 5 is that the wash process sensor 300 shown in FIG. 6 is provided with a microcontroller that is capable of monitoring the measured values received from the sensor components and calculating a simplified value that represents the cleanliness of the articles being washed. As an example, rather than providing information relating to transmitted light, scattered light, temperature, conductivity and rotational speed of the wash arm, the wash process sensor 300 provides a single value to the host microcontroller 130 that tells the microcontroller how clean the articles are. This cleanliness value can be calculated by any one of a number of well known algorithms used by the microcontroller of the wash process sensor 300 that combine all of the information received pertaining to the physical parameters. This cleanliness value is calculated as a function of the turbidity which indicates the decree of particular matter suspended in the washing fluid, the temperature, the conductivity of the washing fluid which indicates the presence or absence of detergent, food particles or dirt and rinse aid material. In addition, the rotational speed of the wash arm represents the water pressure that causes the arm to rotate and also determines the amount of water being sprayed on the dishes.

If the wash process sensor 300 constantly calculates a value representing the cleanliness of the articles being washed, that single value can be transmitted at a relatively high frequency on line 310 to the host microcontroller 130 without the need for the microcontroller to request the information. The transmission on line 310 is simplified because only a single value is provided by the wash process sensor 300. Although it is anticipated that a single digital value can be used, it should also be understood that an analog signal could be used to represent this calculated parameter. At any time during the washing or rinsing cycles, the host microcontroller 130 can receive the most recently transmitted cleanliness value on line 310 and take the appropriate steps with regard to the control of the heating coil 106, rinse aid dispenser 124, pump motor 182, detergent dispenser 180 blower motor 120, user display 190 or valve 108. By comparing FIGS. 5 and 6, it can be seen that the speed of data communication can be significantly enhanced in the system shown in FIG. 6 and, in addition, the information received on line 310 is much more current than the information received on line 160 in FIG. 5 following a request on line 202 from the microcontroller to the wash process sensor. FIG. 6 represents one embodiment of the present invention.

FIG. 7 represents another embodiment of the present invention. The primary difference between the systems shown in FIGS. 6 and 7 is that the wash process sensor/controller 380 in FIG. 7 performs all sensing and control functions necessary for the machine for washing articles. In other words, no host microcontroller 130 is necessary. In the embodiment of FIG. 7, the wash process sensor/controller 380 receives the raw measurements from the various sensors and monitors the magnitudes and rates of change of transmitted light, scattered light, temperature, conductivity and wash arm RPM. After measuring these physical parameters, the wash process sensor/controller 380 calculates the degree of cleanliness or dirtiness of the articles and immediately takes the appropriate action to control the physical devices shown in FIG. 7. The wash process sensor/controller 380 is provided with the necessary interface 200 to convert the logic level voltage signals to control level signals. The wash process sensor/controller 380 shown in FIG. 7 comprises a microcontroller that can be equipped with a fuzzy logic kernel 170. However, the use of fuzzy logic is not necessary in all embodiments of the present invention. The advantages of the embodiment shown in FIG. 7 are apparent. First, the wiring is significantly reduced because there is no need to connect the wash process sensor/controller 380 with any other controller of the machine for washing articles. The interface 200 can be disposed near the wash process sensor/controller 380 and control lines can be extended directly from the interface 200 to the devices that are controlled by the wash process sensor/controller. In addition, the control of the devices can be immediately performed following a change in the representative value of cleanliness of dirtiness calculated by the microcontroller. The control actions taken by the wash process sensor/controller can follow immediately after changes occur in the physical parameters. In addition, only one microcontroller is necessary for the machine for washing articles.

In the embodiments of the present invention, shown in FIGS. 6 an 7, the wash process sensor 300 and the wash process sensor/controller 380 perform all necessary functions for determining the magnitude of a value that represents the cleanliness of the articles. No other microcontroller is necessary for the measuring, monitoring an calculating functions. In both embodiments, the wash process sensor or wash process sensor/controller performs all necessary procedures for determining the state of the washing process as represented by the cleanliness or dirtiness of the articles being washed. The primary difference between the embodiments shown in FIGS. 6 and 7 is that, in the embodiment of FIG. 6, the host microcontroller 130 is used to perform the algorithmic steps of the washing and rinsing cycles. However, even in the simpler embodiment of FIG. 6, it should be understood that the host microcontroller performs those algorithmic steps of the washing and rinsing cycles based solely on the information provided to it on line 310 by the wash process sensor 300. In the embodiment shown in FIG. 7, this step is eliminated and the wash process sensor/controller also performs the algorithmic functions necessary for the washing and rinsing cycles.

Figure 8:
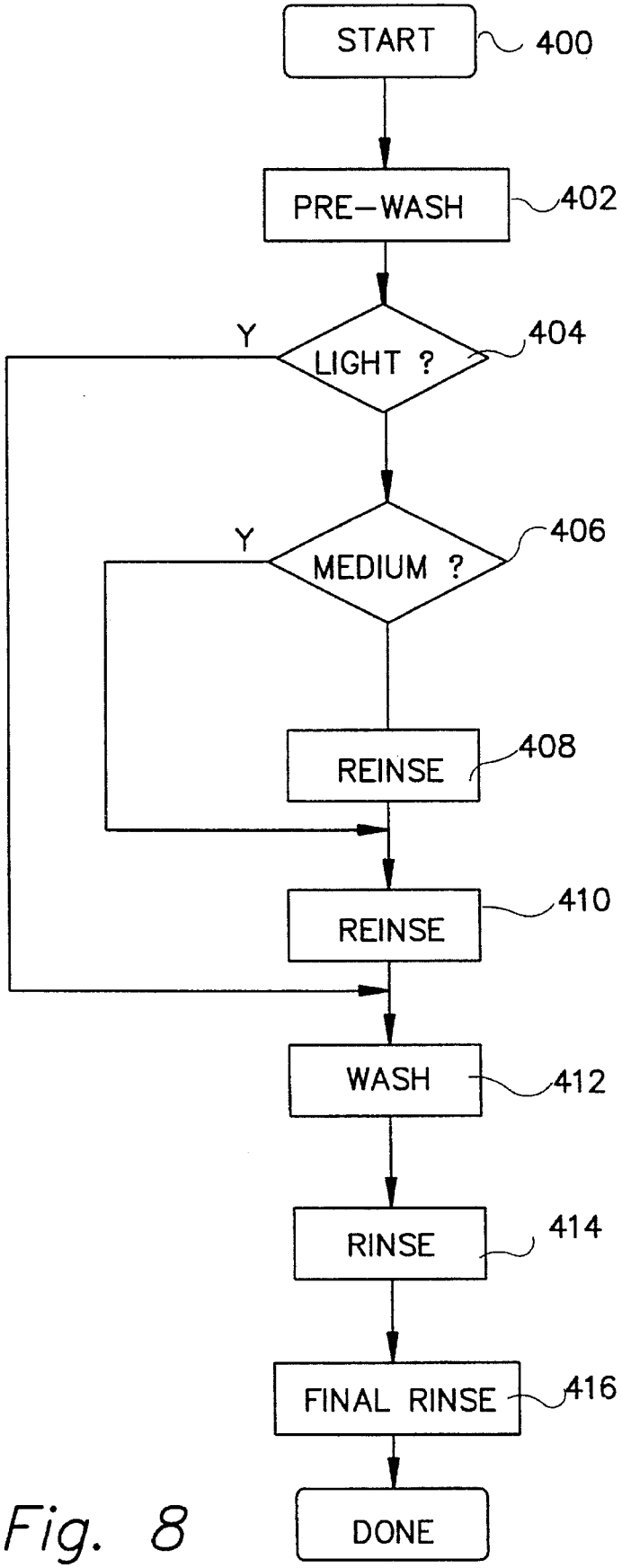
FIGS. 8–15 show flowcharts of a wash cycle, a pre-wash cycle, a wash cycle, a rinse cycle, a final rinse cycle, a cycle start routine, a cycle end routine and a cycle selection function.

FIG. 8 shows a simplified flow chart that can be performed by the wash process process/controller 380 in FIG. 7. When the wash cycle is initiated, at function block 400, a prewash procedure 402 is performed. The algorithm determines whether a light wash 404 or a medium wash 406 is desired. Based on these decisions, rinse cycles 408 and 410 can be performed. A wash cycle 412 is then followed by an additional rinse cycle 414 that proceeds a final rinse 416.

Figure 9:
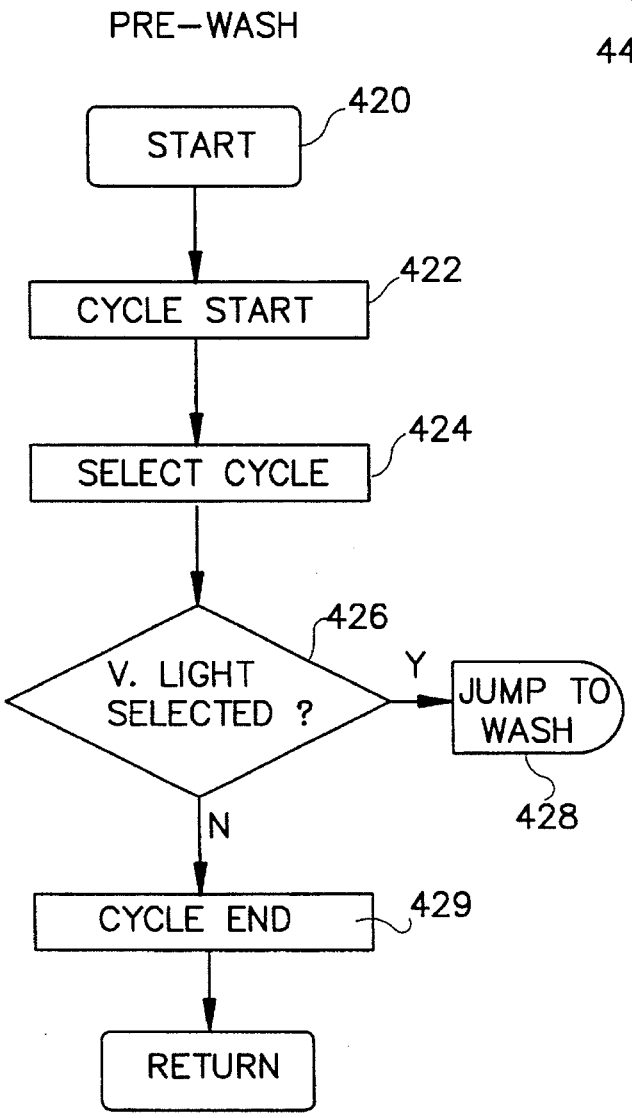

FIG. 9 represents the software used to perform a prewash. Beginning at function block 420 the cycle is begun at block 422 and a particular cycle is selected block 424. The software determines, at function block 426, if a very light cycle is selected. Based on this decision step, the software either proceeds to the wash cycle at block 428 or ends the process at function block 429.

Figure 10:
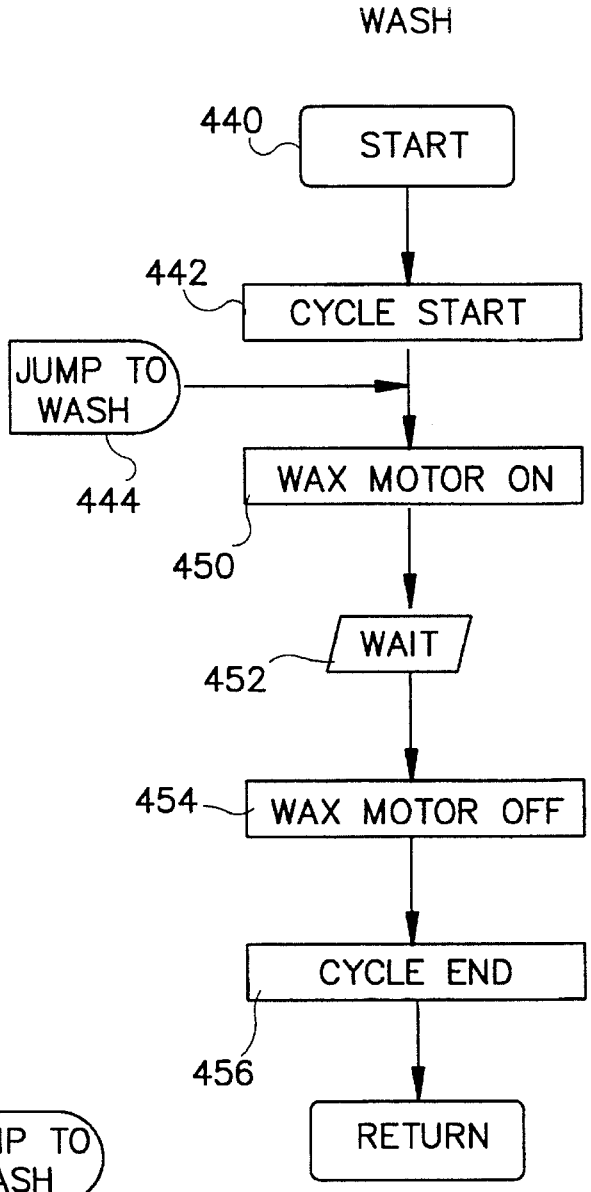

FIG. 10 shows a simplified flow chart of a wash cycle. It starts at function block 440 and begins the cycle at 442. The wash cycle could possible be initiated from the prewash cycle of FIG. 9, as represented by function block 444 or, alternatively, at the beginning of the wash cycle as represented by function block 440. The release device, which controls either the rinse aid dispenser or the detergent dispenser, is turned on at block 450 and a preselected time delay 452 is executed. Then the dispenser is turned off at 454 and the cycle is terminated at 456.

Figure 11:
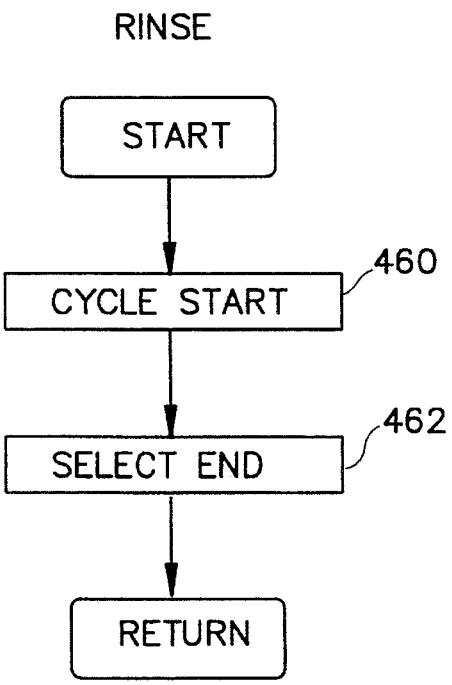
Figure 12:
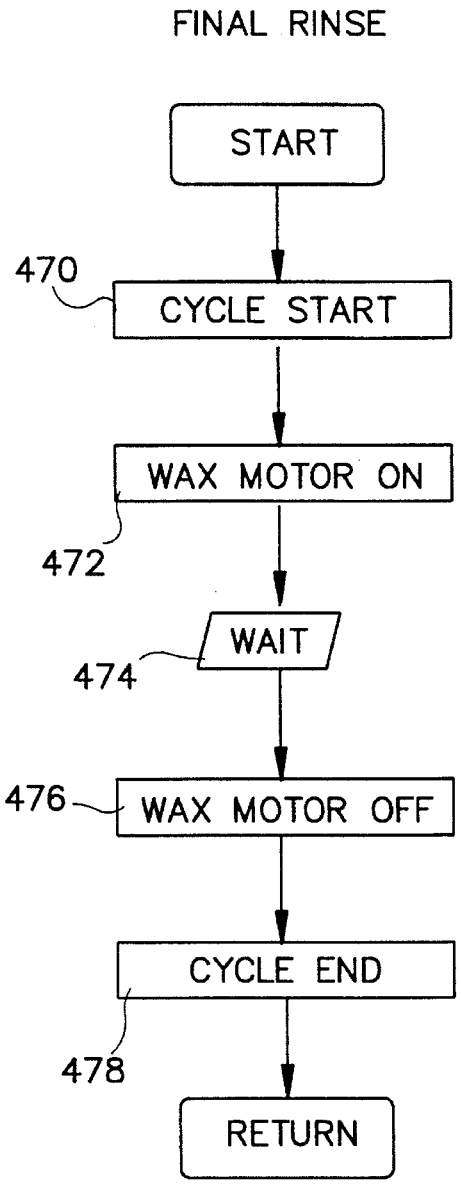

FIG. 11 represents a simplified flowchart of a rinse cycle that begins the rinsing process at function block 460 and terminates at function block 462. FIG. 12 shows a flow chart of a final rinse process that begins at function block 470, turns the was motor on at block 472 and executes a preselected time delay at block 474. The release device is turned off at block 476 and the final rinse cycle is terminated at block 478.

Figure 13:
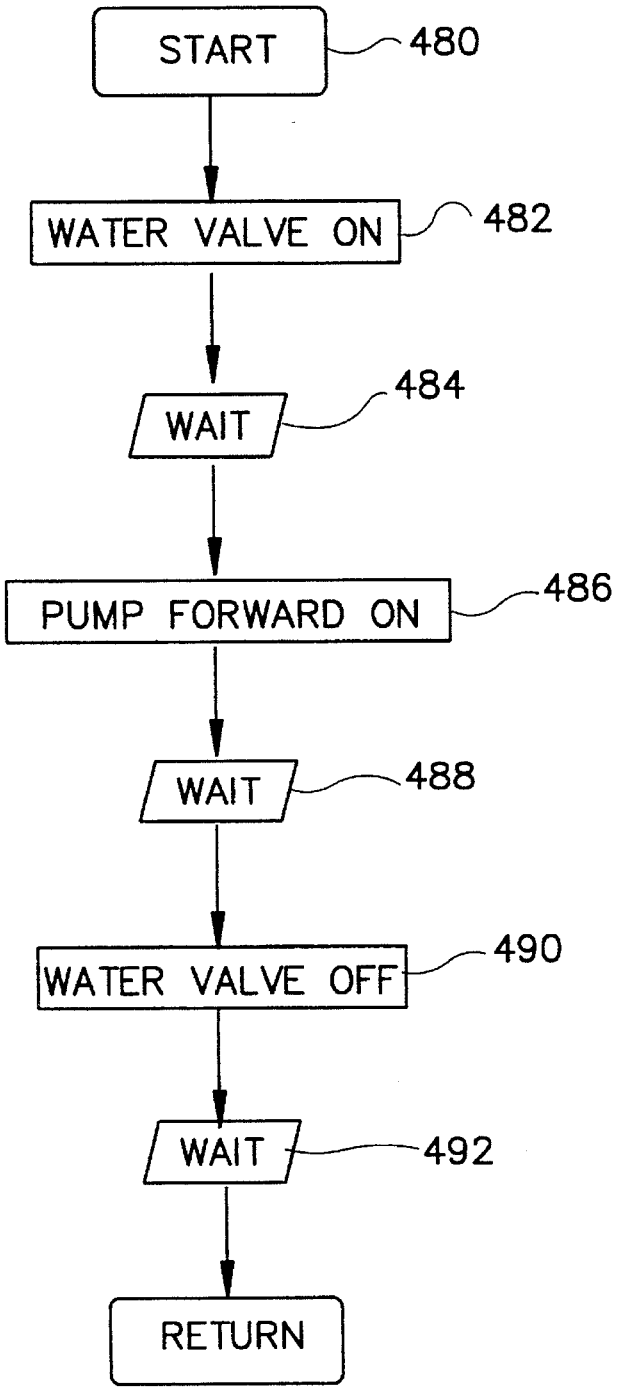

FIG. 13 shows a cycle start routine that begins at function block 480, turns the water valve on at block 482 and executes a preselected time delay at block 484 until a desired amount of water flows into the machine for washing articles. Then the pump is turned on at block 486, a time delay is executed at block 488 and the valve is turned off at block 490. After a preselected time delay at block 492, the cycle start routine returns to the software that initially began its execution.

Figure 14:
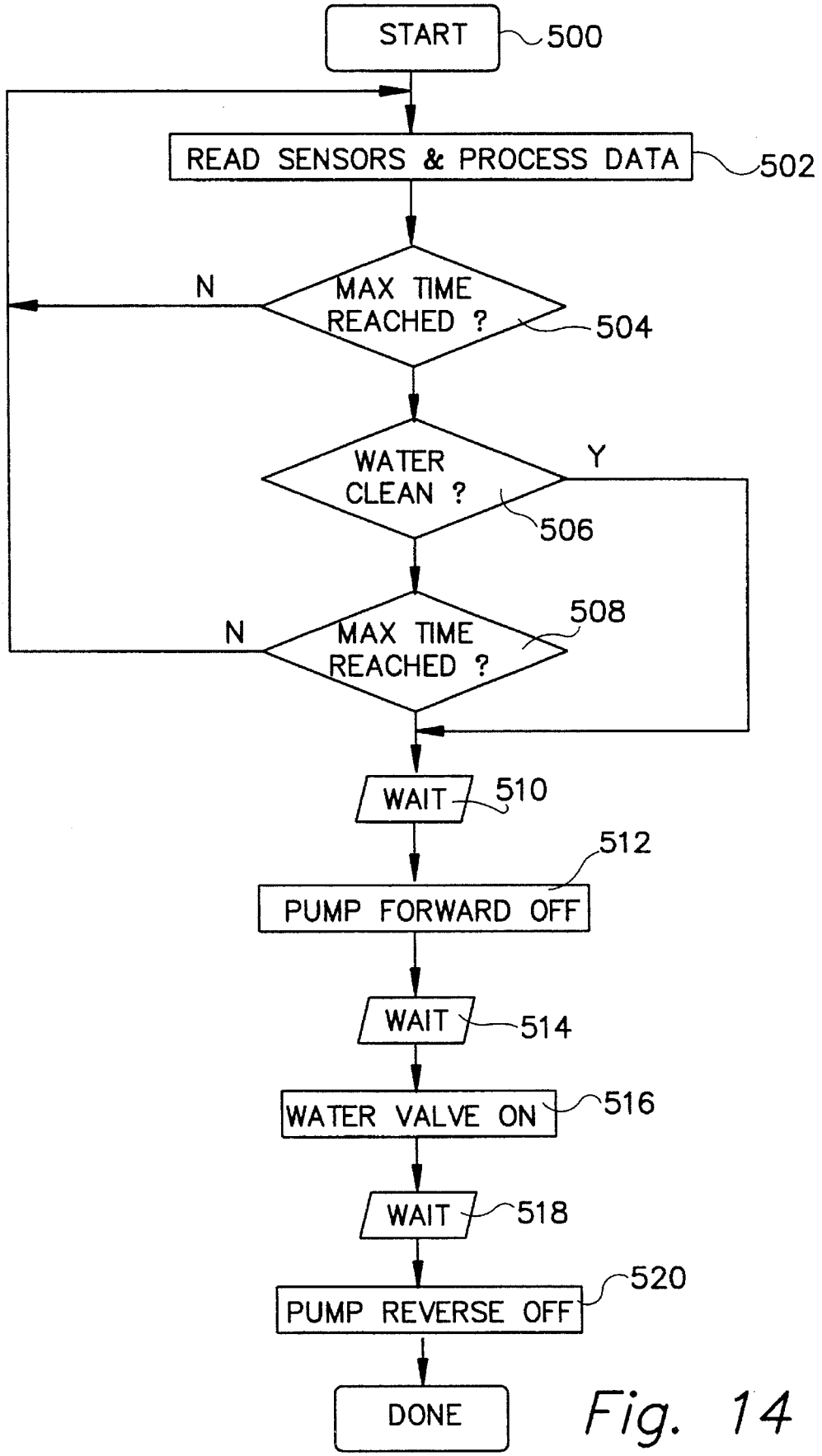

The cycle end routine is shown in FIG. 14. After beginning the cycle end routine at block 500, the various sensors and process data are read at block 502. Decision blocks 504, 506 and 508 are executed as shown and then a preselected time delay is performed at block 510. The pump is turned off at block 512 and, after a delay at block 514, the pump is reversed at block 516. Following a delay at block 518, the reverse pump action is turned off at block 520.

Figure 15:
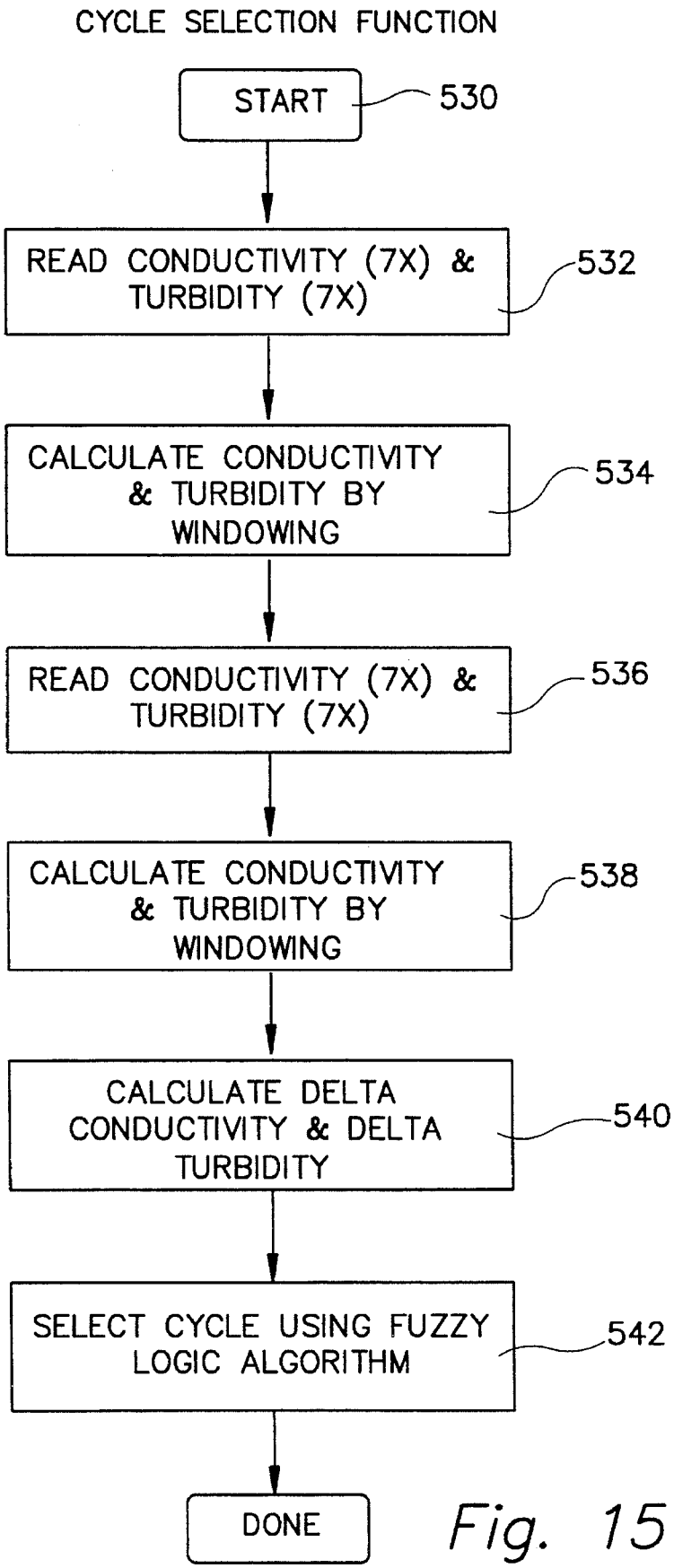

FIG. 15 shows the cycle selection function which begins at function block 530 and is followed by a reading of the conductivity and turbidity parameters at function block 532. The conductivity and turbidity parameters are calculated at function block 534. It should also be understood that other parameters could be monitored simultaneously with the conductivity and turbidity parameters. In the flowcharts, the term "wax motor" is alternatively used to describe the release device and the term "windowing" is used to describe the use of a moving average technique. Then, the conductivity and turbidity are read again at function block 536 and are again calculated at block 538. The rate of change is determined for both the conductivity and turbidity at function block 540 and an appropriate cycle is selected using a fuzzy logic algorithm as indicated by block 542.

Throughout the Description of the Preferred Embodiment, the parameters relating to turbidity, conductivity, temperature and wash arm rotation have been used to describe the operation of the present invention. It should be understood that these physical parameters can be used in many different ways to determine the appropriate control of a washing process. That particular control depends on the selected algorithm and the chosen philosophy of washing the articles. Different designers could apply the same basic information in different ways to optimize the washing of articles, such as dishes or clothes. Therefore, it should be understood that the specific algorithms use to control the washing of the articles are not limiting to the present invention.

Figure 16:
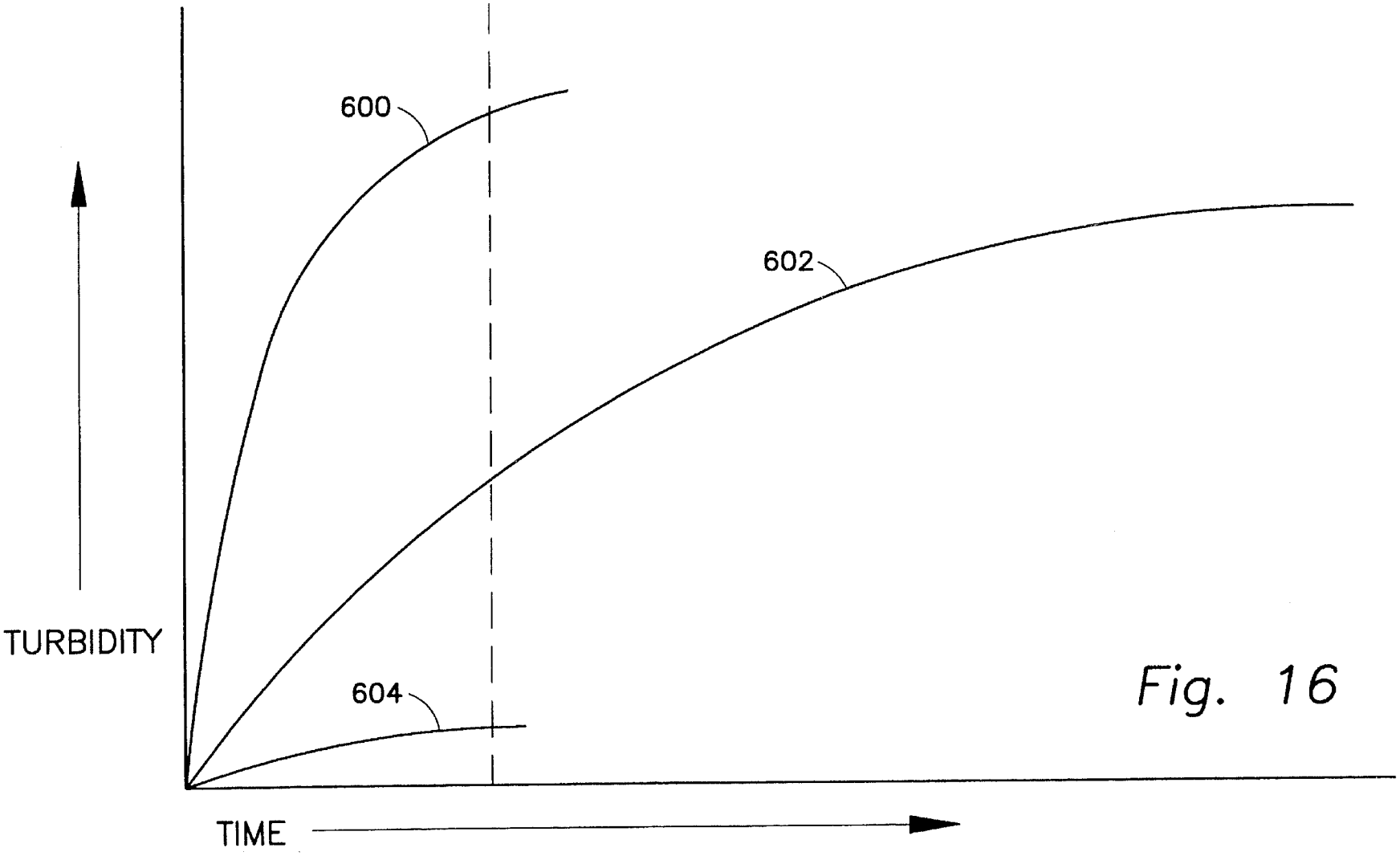
FIG. 16 is a graphical representation of three illustrative turbidity graphs as a function of time.

FIG. 16 illustrates how one specific variable can be used in several different ways. In FIG. 16, the turbidity of the washing solution is shown in a graphical manner as a function of time. Three lines, 600, 602 and 604 are used to represent various ways that the turbidity value can change over time. The information represented in FIG. 16 can be used by different algorithms to result in different control schemes. For example, the rate of change of turbidity at time T1 is significantly reduced from its previous rate and might indicate the desirability to end the wash cycle because the turbidity is not changing at a sufficient rate to indicate that the washing process is still effective. On the other hand, the rate of change represented by line 602 might indicate that the change in turbidity represents an efficient operation of the washing cycle and, in addition, it could indicate that the washing cycle should be continued beyond time T1. The information represented by line 604 might indicate that the turbidity in the washing cycle is so low that some type of improper situation is occurring. For example, the machine for washing articles might have been initiated inadvertently even though the articles have already been cleaned and are dispersing no soil into the washing solution. This type of procedure would be highly inefficient and the cycle could be stopped because the turbidity value did not reach a predetermined threshold within a preselected time period. FIG. 16 is intended to illustrate the fact that different algorithms could treat the same information in different ways depending on the absolute value an the rate of change. It also indicates that not only the absolute value of the parameter, but the rate of change of the parameter, can be used by the algorithm to determine when certain procedural steps should be taken during the washing process.

In the Description of the Preferred Embodiment, the present invention was described in terms of the turbidity of the wash solution, the conductivity of the wash solution, the temperature of the wash solution and the rotational speed of the wash arm. The turbidity of the wash solution indicates the clarity of the solution which, in turn, indicates the amount of particulate matter present in the water used to wash the articles. This debris could be food matter, detergent or bubbles. An increase in turbidity typically translates to a reduction in the clarity of the wash solution. The conductivity of the wash solution is used to detect the presence of soap in the water. An increase in conductivity indicates that soap is present in the wash solution. The temperature of the water can also be used as a process variable for the wash process. The water heater coil in a dishwasher provides a means for controlling the water temperature based on the temperature information provided to the wash process sensor. The rotational speed of the wash arm provides a measure of how fast the wash arm is rotating and this, in turn, indicates the amount of water per unit time that is being used in the process. The first derivative of the information can also be used to supplement the information data base and to provide additional information for a fuzzy algorithm. In addition, the first derivative of the information can be used as a system diagnostic tool to verify the proper functionality of the sensor systems in the dishwasher or clothes washer.

As an example, if the turbidity magnitude is high, the wash cycle will tend to be longer since the wash solution is dirty. If the turbidity is low, the wash cycle may be shorter since the wash solution is clean. If the rate of change in turbidity is positive, the wash cycle will be longer since the wash solution is getting increasingly dirty as time increases and this indicates that the washing process is effective. If the change in turbidity is negative, the wash cycle will be shorter since the wash cycle is getting increasingly clean as time increases. If the conductivity of the water is high, the wash cycle is shorter since the wash solution has soap present in it. Alternatively, if the change in conductivity is positive the wash cycle might be shorter since the wash solution has soap dissolving in it. If the conductivity is low, the wash cycle might be longer since the wash solution does not have soap present and, if the change in conductivity is negative, the wash cycle can be longer since the soap in the wash solution is being bound up by the debris in the water.

If the temperature of the water is low, it can be heated by activating the heating coil. If the change in temperature is negative, it is cooling and perhaps the heater should be activated. All of the information provided by the wash process sensor and its associated sensing components can be provided as inputs into a fuzzy algorithm that is embedded in the microcontroller of the wash process sensor or the wash process sensor/controller. The fuzzy algorithm can use this information to make a determination as to the level of dirtiness or cleanliness of the wash solution. That information, in turn, is used to select the wash cycle and determine at what point the load of articles in the dishwasher is considered clean. The selected wash cycle dictates the control functions executed, either by the host microcontroller or by the sensor cluster microcontroller of the wash process sensor/controller.

Among the many advantages of the present invention, it reduces the processing overhead for the main controller when the wash process sensor of the embodiment shown in FIG. 6 is used. This allows existing electronic timers to be retrofitted easily. In addition, many different algorithms can be implemented in the wash process sensor to make it widely applicable to many different machines for washing articles. It can also provide redundancy. In other words, if the wash process sensor of FIG. 6 fails for any reason, the routines used by the host controller can default to predetermined wash routine times and rinse routine times of traditional machines for washing articles. This significantly reduces annoyance if a component fails. The embodiment shown in FIG. 7 also provides certain significant advantages. It eliminates the need for complex controller boards in a machine for washing articles and reduces the wiring which normally travels between the controller board and the wash function devices. This reduces costs in both material and assembly. Furthermore, the measurement, control and actuation are placed in close proximity to each other and provides easier access during serving of the machine.

Although the present invention has been described with particular detail and illustrated with specificity to show certain embodiments of the present invention, it should be understood that alternative embodiments are within its scope.

The embodiments of the invention in which an exclusive property or right is claimed are defined as follows:

1. An apparatus for monitoring and controlling the operation of a machine for washing articles, comprising:

means for measuring a plurality of physical parameters that relate to the progress of washing said articles;

means, connected in signal communication with said measuring means, for monitoring changes in the magnitude of said plurality of physical parameters over time to determine said progress of washing said articles;

means, connected in signal communication with said monitoring means, for calculating a value as a function of said changes and of said physical parameters which is representative of the state of cleanliness of said articles;

a sensor housing structure, said measuring, monitoring and calculating means being contained within said sensor housing structure; and means, connected in signal communication with said calculating means, for controlling a plurality of devices that affect the operation of said machine for washing articles.

2. The apparatus of claim 1, wherein:

said plurality of physical parameters comprise turbidity, temperature and conductivity.

3. The apparatus of claim 2, wherein:

said plurality of physical parameters further comprises the rotational speed of a wash arm of said machine for washing articles.

4. The apparatus of claim 1, wherein:

said monitoring means comprises a microcontroller.

5. The apparatus of claim 1, wherein:

said calculating means comprises a microcontroller.

6. The apparatus of claim 1, wherein:

said controlling means is contained within said sensor housing structure with said measuring, monitoring and calculating means.

7. The apparatus of claim 1, wherein:

said plurality of devices comprises a motor, a dispenser and a valve.

8. The apparatus of claim 7, wherein:

said plurality of devices comprises a blower motor, a detergent dispenser, a pump motor, a rinse aid dispenser and a heating coil.

9. The apparatus of claim 1, wherein:

said machine for washing articles is a dish washer.

10. The apparatus of claim 1, wherein:

said machine for washing articles is a clothes washer.

11. The apparatus of claim 1, wherein:

said sensor housing structure is disposed within a pump housing of said machine for washing articles.

12. The apparatus of claim 1, further comprising:

a fuzzy logic device connected in signal communication with said monitoring and calculating means.

13. An apparatus for monitoring and controlling the operation of a machine for washing articles, comprising:

means for measuring a plurality of physical parameters that relate to the progress of washing said articles;

means, connected in signal communication with said measuring means, for monitoring changes in the magnitude of said plurality of physical parameters over time to determine said progress of washing said articles;

means, connected in signal communication with said monitoring means, for calculating a value as a function of said changes and of said physical parameters which is representative of the state of cleanliness of said articles;

a sensor housing structure, said measuring, monitoring and calculating means being contained within said sensor housing structure; and means, connected in signal communication with said calculating means, for controlling a plurality of devices that affect the operation of said machine for washing articles, said controlling means is contained within said sensor housing structure with said measuring, monitoring and calculating means.

14. The apparatus of claim 13, wherein:

said plurality of physical parameters comprise turbidity, temperature and conductivity.

15. The apparatus of claim 14, wherein:

said plurality of physical parameters further comprises the rotational speed of a wash arm of said machine for washing articles.

16. The apparatus of claim 13, wherein:

said monitoring means comprises a microcontroller, said calculating means comprises a microcontroller, said plurality of devices comprises a blower motor, a detergent dispenser, a pump motor, a rinse aid dispenser and a heating coil.

17. The apparatus of claim 16, wherein:

said machine for washing articles is a dish washer.

18. The apparatus of claim 16, wherein:

said machine for washing articles is a clothes washer.

19. The apparatus of claim 13, wherein:

said sensor housing structure is disposed within a pump housing of said machine for washing articles.

20. An apparatus for monitoring and controlling the operation of a machine for washing articles, comprising:

means for measuring a plurality of physical parameters that relate to the progress of washing said articles;

means, connected in signal communication with said measuring means, for monitoring changes in the magnitude of said plurality of physical parameters over time to determine said progress of washing said articles, said monitoring means comprising a microcontroller, said calculating means comprises a microcontroller, said plurality of devices comprises a blower motor, a detergent dispenser, a pump motor, a rinse aid dispenser and a heating coil;

means, connected in signal communication with said monitoring means, for calculating a value as a function of said changes and of said physical parameters which is representative of the state of cleanliness of said articles;

a sensor housing structure, said measuring, monitoring and calculating means being contained within said sensor housing structure, said sensor housing structure being disposed within a pump housing of said machine for washing articles; and means, connected in signal communication with said calculating means, for controlling a plurality of devices that affect the operation of said machine for washing articles, said controlling means is contained within said sensor housing structure with said measuring, monitoring and calculating means, said plurality of physical parameters comprising turbidity, temperature and conductivity.

* * * * *